United States Patent [19]

Koren

[11] 4,179,613

[45] Dec. 18, 1979

[54] BOW DRAW INDICATOR AND SIGHTING DEVICE

[76] Inventor: James T. Koren, 1915 Grand St., Trevose, Pa. 19047

[21] Appl. No.: 901,859

[22] Filed: May 1, 1978

[51] Int. Cl.[2] ..... F41G 1/32

[52] U.S. Cl. ..... 250/215; 124/87; 33/265

[58] Field of Search ..... 250/215, 561; 33/265; 124/87

[56] References Cited

U.S. PATENT DOCUMENTS

| | | |
|---|---|---|
| 3,524,440 | 8/1970 | Hill . |
| 3,667,444 | 6/1972 | Depatie et al. . |
| 3,766,656 | 10/1973 | Westphal . |
| 3,833,799 | 9/1974 | Audet . |
| 3,867,920 | 2/1975 | Westphal . |
| 3,910,700 | 10/1975 | Sprandel . |
| 3,945,127 | 3/1976 | Spencer . |
| 3,960,453 | 6/1976 | Svensson et al. . |

*Primary Examiner*—David C. Nelms
*Assistant Examiner*—Darwin R. Hostetter
*Attorney, Agent, or Firm*—Gerald S. Rosen

[57] ABSTRACT

A bow draw indicator and sighting device mounted on a bow provides signals which enable the archer to adjust the bow vertically and horizontally to assure proper aim. Also an arrow draw indicator signal is provided which signal operates only when the bow is in proper vertical position. The device is battery powered. The bow draw and the vertical signal is either an audible signal or a light emitting diode. The horizontal (elevation) signal is in the sight and comprises light emitting diodes at the upper and lower portions of the sight. The device is small and light enough to be easily mounted on the bow and to have utility for both hunting and target purposes and can be used with aluminum or other electrically conductive arrows.

15 Claims, 6 Drawing Figures

BOW DRAW INDICATOR AND SIGHTING DEVICE

BACKGROUND OF THE INVENTION

Archery is one of the most difficult of all sports due to the demand for consistent accuracy in order to enjoy success in this sport. What makes archery so difficult is that each time the archer shoots an arrow he is faced with the necessity of adjusting several important variables. He must adjust elevation of the arrow to compensate for distance and the horizontal angle for windage. Even if he is able to complete these adjustments successfully, he must repeatedly draw the arrow each time to the same anchor point in order to assure that the adjustments used result in the desired aim. The archer must further make sure that he does not torque the bow up, down, or sideways. All of these variables and others require very significant skills which generally are acquired only through experience. If compensation is not made for all of these variables, then the net result must be that the target will either be missed or the cluster on the target will be off center and inconsistent from one series of shots to another.

Traditionally, the archery bow is fired by the archer sighting along the length of the arrow and directing the arrow in predetermined relationship with respect to the target before releasing the arrow. Various devices have been developed which aid the archer in making the adjustments and aiming, so that the archer does not depend entirely on manual skill and dexterity.

Examples of mechanical aids to the archer are e.g., bubble levels, which have been introduced into or near the sight to tell the archer if the bow is vertical or canted off the vertical. Such tilting of the bow while shooting can cause inconsistencies in the arrow groupings, as well as errors in windage adjustments. Bubble levels are disadvantageous because they require the archer to split his concentration between the target and the levels.

A mechanical means by which an archer can assure that the arrow is drawn to the same spot every time is a device called a clicker. This device is made from a piece of spring steel attached to the bow in front of the arrow rest. The clicker is lifted from the bow and the arrow is placed on the arrow rest. The tension on the clicker is then released, causing the spring steel to rest firmly against the shaft of the arrow. When the arrow is fully drawn the point of the arrow passes the spring steel of the clicker, which causes the metal to impact the bow solidly, creating an audible sound. This sound tells the archer he is at full draw. The advantage of this device is that the archer can be certain that the arrow is drawn and released at the same spot with each shot. This disadvantage of the metal clicker is that shooting prematurely while concentrating on the target causes the feathers or vanes to be torn off the shaft of the arrow. In addition, a device as in U.S. Pat. No. 3,867,920 uses electric current to activate a signal when the arrow is fully drawn. This device utilizes a band of metal on the arrow which completes a current. This device is not suitable for use with the widely used aluminum arrow which is electrically conductive.

There are various types of bow sighting devices which are known to the art. These devices utilize an assortment of methods to make the various compensations discussed herein. Many have one or more sight pointers, which are typically preset for various ranges prior to drawing of the bow. These devices are convenient when target shooting at known ranges. The signt pointer is not readily adjustable for all distances as the range changes and when the bow is drawn. There are devices which are best used for target archery where distances are known, while others are designed for actual hunting where distances are unknown and where the distances change rapidly. Sample patents teaching various devices include U.S. Pat. No. 3,667,444 (1972); U.S. Pat. No. 3,524,440 (1970); U.S. Pat. No. 3,766,656 (1973); U.S. Pat. No. 3,867,920 (1975); U.S. Pat. No. 3,945,127 (1976); and U.S. Pat. No. 3,910,700 (1975).

Because most of the prior art devices depend for their adjustment upon the skill of the archer, there has been need for mechanical sighting means which are convenient to use, are readily attached to the bow, are accurate, can be used with non-conductive and condictive arrows, and do not depend entirely on the skill of the archer for adjustment.

SUMMARY OF THE INVENTION

This invention relates to a sighting and arrow draw monitor device which enables the archer to consistently aim an arrow with a minimum amount of distraction.

The device, which is operable with electrically conductive as well as non-conductive arrows, is attachable to a bow, has an energy source for producing a signal which indicates horizontal (elevation) accuracy, a mercury switch for indicating vertical position of the bow, and a photoelectric sensor for indicating bow draw accuracy. In addition, the energy source powers a vibration indicator which causes the signals to be erratic if the bow is vibrating too much in the hands of the archer. The advantage of this invention is that the archer can concentrate on the target without the need for removing the concentration from the sight, since the sight indicates whether or not the horizontal is being maintained, and the arrow draw indicator, which is either a light on the sight or a sound, indicates both if the vertical is being maintained and the arrow is drawn to the proper point.

DETAILED DESCRIPTION OF THE INVENTION

Figure 1:
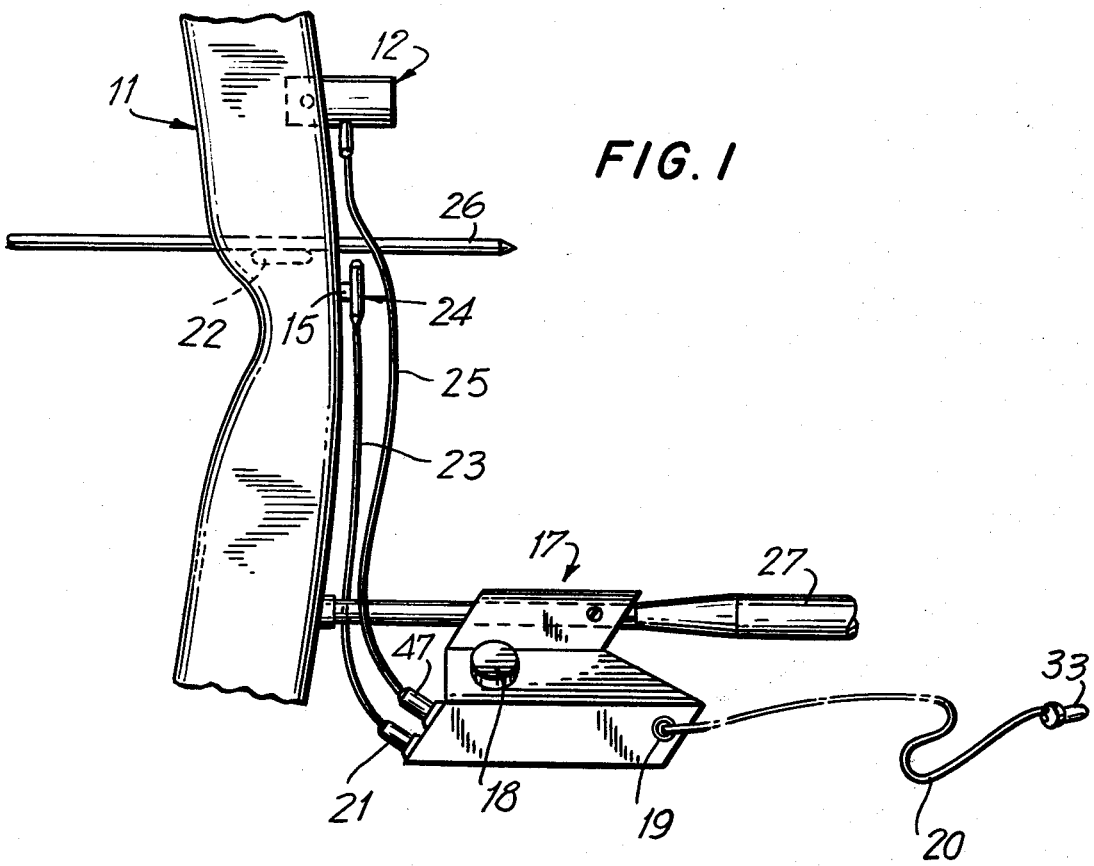
FIG. 1 is a side view of the bow aiming device and draw indicator of the invention, with a fragmentary view of a bow and arrow.

The device of this invention combines the draw indicator, horizontal and vertical leveling and the sighting system into one electronic package where the signals are inter-dependent and positioned adjacent to or in the sighting device. This enables the archer to concentrate on the target rather than on the controls attached to the equipment.

The device of this invention consists of the following components—the power supply package, the photoelectric sensor, vertical control means, horizontal or sight elevation control means. The horizontal and vertical control means also act as vibration indicators.

The power supply package can be attached to the bow at any convenient location, using appropriate attaching devices. The power supply package has a battery as the power source and is activated by completion of the circuits of the various controls. The battery can be of any convenient type and size. It has been found that a nine volt transistor battery is sufficient. Inside the main power supply package is located a dual monostable multivibrator integrated circuit which sends an audible signal through an earphone when the earphone is plugged into an earphone jack in the power package. The audible signal inside the unit can be switched on by unplugging the earphones. This audible signal is sent through the earphone when the earphone is plugged into the power source permitting archer to shoot without disturbing fellow archers. A potentiometer is located in the power package and is controlled by a knob. The potentiometer is used to adjust the photoelectric sensor to respond to the desired amount of light sensitivity. Two jacks on the rear of the power package allow the sight and photoelectric sensor to be easily disconnected and removed for transportation or storage.

The photoelectric sensor is attached to the front of the bow in a position slightly below the level of the arrow rest. This permits the arrow, when not fully drawn, to shade the sensor from ambient light, thus increasing the resistance of the photo cell therein and stopping the flow of electricity to the indicators. When the arrow is in the full draw position, the photo cell is exposed to ambient light which causes the resistance to decrease, allowing current to pass through a power transistor in the power package which causes a signal to activate. The signal is either a light emitting diode located in the center of the sight or a buzzer, which is in the power package. The photoelectric sensor is attached to the power package through a jack by a detachable wire. The light sensitivity of the photo cell can be adjusted to the desired sensitivity by means of a knob on the power package which operates a potentiometer located in the power package.

The vertical control means is an automatic switch which opens an electric circuit when the bow is tilted more than a preset angle from the vertical. The electric circuit this switch operates is the circuit which also operates the arrow draw signal. Thus, when the bow is not vertical, the full draw signal will not operate and the archer should not shoot. A suitable switch preferred for use in this invention is a mercury switch, which is located in the power package between the power source and the signals. This switch also acts as the vibration indicator by causing the arrow draw signal to turn off and on when the bow vibrates.

The horizontal control or sight elevation is monitored by two adjustable omnidirectional sensors which are located at the sight. The sensors can be adjusted to any desired elevation. The adjustment can be made for a fixed or moving target. One sensor lights one or more light-emitting diodes in the upper part of the sight when the bow is elevated above the horizontal elevation, which elevation is set for the range of the target by means known to the art. The other sensor lights one or more light-emitting diodes in the lower part of the sight when the bow is lowered below the set horizontal elevation. This elevation can be preset for target shooting or set by a knob for hitting targets at different distances. The omnidirectional sensors and signals are connected to the battery in the power supply package through a jack by a detachable wire. When the bow is at the correct sight elevation, the upper and lower light-emitting diodes are either all on or all off according to how they are set.

The sight, which contains the omnidirectional sensors, is attached to the front (or side) of the bow by an appropriate device and is at a convenient level, so that the archer can sight the target through it. The sight can contain, if it is used, a light for indicating the full bow draw.

The vibration indicator is the same mercury switch in the power supply package which indicates the vertical position of the blow. This switch also turns off the bow draw signal if the bow is vibrating too much during full draw and sighting. This vibration indicator causes the various signals which are seen, i.e., the light-emitting diodes, or heard, i.e., the buzzer, to be erratic. This causes the archer to realize that the bow is vibrating too much and to take corrective measures. This is particularly useful for a beginning archer who does not have the expertise to realize when vibration is such that the aim will be off. It is not necessary to the operation of the device that the mercury switch be set at a sensitivity to operate as a vibration indicator, but it is a preferred embodiment of the invention. The omnidirectional sensors also act as vibration indicators. Excess vibration is manifested by a flickering of the light emitted in the sight.

In order to promote a better understanding of the invention, reference will now be made to the embodiment illustrated in the drawings. It will nevertheless be understood that no limitation of the scope of the invention is thereby intended, such alterations and further modifications in the illustrated device, in such further applications of the principle of the invention as illustrated therein being contemplated as would normally occur to one skilled in the art to which the invention relates.

FIG. 1 discloses the device fully assembled on the bow 11. The power package 17 is on the front stabilizer 27 of the bow 11. On the power package 17 are the potentiometer knob 18 for adjusting the photoelectric sensor 24 to ambient light. In addition, the power package 17 has a jack 19, to which a wire 20 is attached to an earplug 33 for the sound indicator to be heard by the archer. The sight 12 is attached to the power pack 17 by wire 25 plugged into a jack 47. The sensor 24 is attached to the power pack 17 by wire 23 plugged into a jack 21. The sensor 24 is attached to the front of the bow 11 by a bracket 15. The arrow 26 is shown as covering the end of the sensor 24, and the arrow 26 is on the arrow rest 22.

Figure 2:
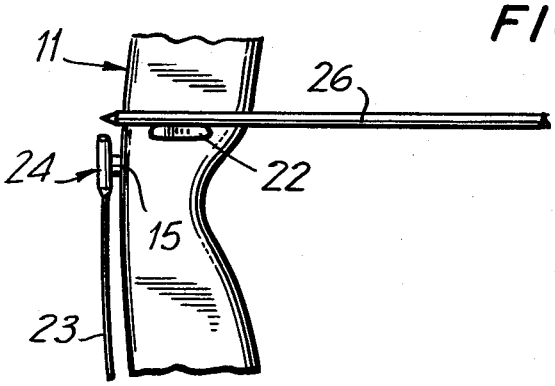
FIG. 2 is a side view of the draw indicator of the invention with the arrow at full draw.

FIG. 2 shows the arrow 26 resting on the arrow rest 22 at full draw, where the sensor 24 attached to the bow 11 by a bracket 15 and connected by a wire 23 to the power package (not shown) is uncovered, permitting the signal to operate.

Figure 3:
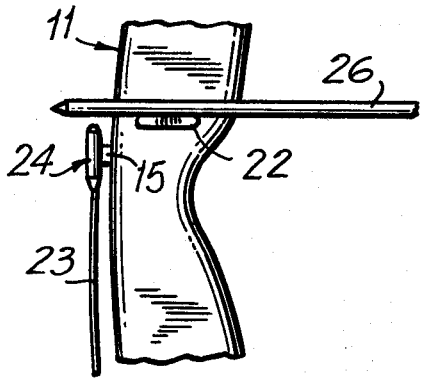
FIG. 3 is a side view of the draw indicator of the invention with the arrow at partial draw.

FIG. 3 is the same view showing the arrow 26 covering the end of the sensor 24, preventing ambient light from reaching the sensor 24 and thus switching off the signal.

Figure 4:
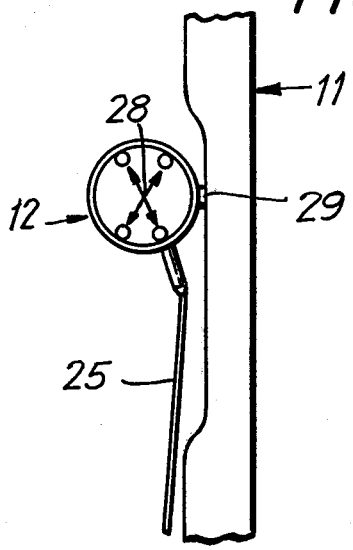
FIG. 4 is a rear view of the aiming device of the invention.

FIG. 4 is a rear view of the sight 12, containing the omnidirectional sensors LED lights 28. The sight 12 is connected to the power package (not shown) at a jack (not shown) by a wire 25. The sight 12 is attached to the bow 11 by a bracket 29.

Figure 5:
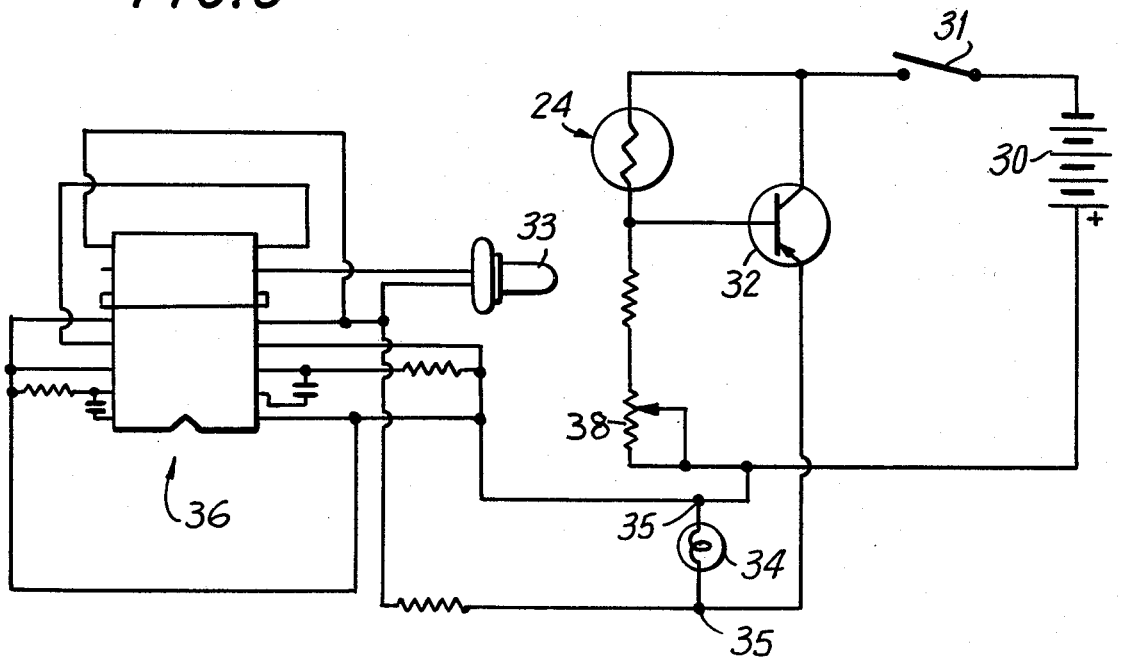
FIG. 5 is a block diagram of the electric circuits of the aiming device and bow draw indicator.

FIG. 5 shows the electric circuitry in the power pack (not shown) which operates the device of this invention. The nine volt transistor battery 30 is the power source. The battery 30 causes current to run through the circuit when the mercury switch 31 is closed. The mercury switch 31 is open when the bow 11 is not properly aligned vertically. When the mercury switch 31 is open, the photocell 24 cannot activate the audible or light signal 34 indicating the arrow is at full draw. Also, if a light is used rather than a buzzer, the light 34 is attached to the center of the sight (not shown) and to the circuit at 35. If the mercury switch 31 is open, none of the signals have power. When the mercury switch 31 is closed, the circuit is completed and the power goes through the photocell 24 if it is activated by light to the transistor 32 then to either the sound signal 34, the light signal 34, or a sound signal through earplug 33 via the multivibrator integrated circuit 36. The sensitivity of the photocell 24 is varied by the potentiometer 38. The integrity of the circuit is maintained if the mercury switch 31 operating also as a vibration indicator is not vibrating beyond a preset degree.

Figure 6:
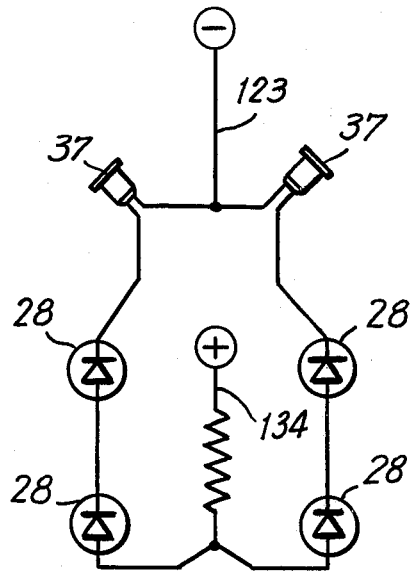
FIG. 6 is a block drawing of the electric circuit of the omni-directional position sensors.

FIG. 6 shows the circuit of the horizontal position sensor where the omnidirectional position sensors 37 activate the LED horizontal indicators 28 when the bow (now shown) is not at the level of elevation which is set for the distance of the target. The wire (not shown) formed from wires 123 and 134 is connected to the battery (not shown) to power the horizontal indicators 28.

I claim:

1. A device suitable for attaching to an archery bow comprising the combination of (a) An energy source, (b) A photoelectric sensor connected to the energy source which activates a signal means when an arrow used with the bow is at predetermined draw, (c) A vertical control means which inactivates said signal means when the bow is canted more than a predetermined angle from vertical, and (d) A sight means connected to the energy source and containing thereon adjustable omnidirectional sensor means set to activate a signal when the bow is not directed to the elevation at which the omnidirectional sensors are set.

2. The device as in claim 1 wherein said vertical control means also acts as a vibration indicator means which causes the signal to be erratic if vibration of the bow is excessive.

3. The device as in claim 2 wherein the vertical control means is a mercury switch.

4. The device as in claims 1 or 2 in which the energy source is a battery.

5. The device as in claims 1 or 2 in which the signal activated by the photoelectric sensor is a light emitting means attached to the sight.

6. The device as in claims 1 or 2 in which the signal activated by the photoelectric sensor is a sound emitted from a sound device attached to the energy source.

7. The device as in claims 1 or 2 in which the signal the omnidirectional sensors activate is light-emitting diodes located on the upper and lower portions of the sight.

8. The device as in claims 1 or 2 in combination with an archery bow.

9. The device as in claim 5 in combination with an archery bow.

10. The device as in claim 6 in combination with an archery bow.

11. The device as in claim 7 in combination with an archery bow.

12. An archery bow having attached thereto the device as in claims 1 or 2.

13. An archery bow having attached thereto the device as in claim 5.

14. An archery bow having attached thereto the device as in claim 6.

15. An archery bow having attached thereto the device as in claim 7.

* * * * *